United States Patent [19]

Okazaki et al.

[11] Patent Number: 4,760,724

[45] Date of Patent: Aug. 2, 1988

[54] METHOD OF AND APPARATUS FOR CONTROLLING OPERATION OF A CROSS HELICAL ROLLING MILL

[75] Inventors: Shuji Okazaki; Mikio Kodaka; Masahiro Kagawa; Shiro Hatakeyama; Teruo Kobayashi; Kingo Sawada, all of Aichi; Shohei Kanari, Chiba, all of Japan

[73] Assignee: Kawasaki Steel Corporation, Hyogo, Japan

[21] Appl. No.: 836,977

[22] Filed: Mar. 6, 1986

[30] Foreign Application Priority Data

Mar. 13, 1985 [JP] Japan ..... 60-048135
Nov. 1, 1985 [JP] Japan ..... 60-243894
Dec. 25, 1985 [JP] Japan ..... 60-290764

[51] Int. Cl.[4] ..... B21B 19/04
[52] U.S. Cl. ..... 72/19; 72/97
[58] Field of Search ..... 72/19, 96, 97, 95, 100

[56] References Cited

U.S. PATENT DOCUMENTS 2,040,764 5/1936 Bannister ..... 72/97
4,320,327 3/1982 Fencl ..... 72/19

FOREIGN PATENT DOCUMENTS 6856 1/1979 Japan ..... 72/19
54410 3/1984 Japan ..... 72/97
1068187 1/1984 U.S.S.R. ..... 72/100

*Primary Examiner*—Lowell A. Larson
*Attorney, Agent, or Firm*—Koda and Androlia

[57] ABSTRACT

A method of controlling the operation of a cross helical rolling mill. The cross helical rolling mill has a pair of work rolls arranged at respective predetermined lead angles, and a pair of power-driven drive roller shoes arranged obliquely at predetermined lead angles on both sides of the rolling region formed between both work rolls. The method comprises controlling the rotation speed of each of the drive roller shoes in synchronism with the speed of rotation of the rolled material such that the difference in the peripheral speed between each of the drive roller shoe and the rolled material falls within a predetermined range, and, simultaneously with the control of the speed, controlling the driving torque applied to each of the drive roller shoes. According to the method, the drive roller shoes impart driving torques to the rolled material, while maintaining the slip between the shoes and the rolled material within a predetermined allowable range, so that the material under the rolling can be held safely and stably, whereby the quality of the rolled product is improved and the lift of the shoes is prolonged. Disclosed also is an apparatus for carrying out this method.

2 Claims, 14 Drawing Sheets

METHOD OF AND APPARATUS FOR CONTROLLING OPERATION OF A CROSS HELICAL ROLLING MILL

BACKGROUND OF THE INVENTION

1. Field of the Invention

The present invention broadly relates to a cross helical rolling mill which is used in the production of seamless pipes such as a seamless steel pipe and, more particularly, to a method of and an apparatus for controlling the operation of such a cross helical rolling mill.

2. Description of the Prior Art

Generally, the piercing step of a seamless steel pipe production line employs a cross helical rolling mill which has a pair of work rolls having an inlet interfacial angle and an outlet interfacial angle, respectively, and arranged at a predetermined lead angle, and guide shoes such as stationary shoes or roller shoes disposed between the work rolls.

FIG. 15 shows the front elevation of a typical conventional cross helical rolling mill. This cross helical rolling mill has a pair of work rolls 1, a plug 2, and a pair of stationary shoes 4. A shell 3, which is shown in section, is tracted by the circumferential frictional forces exerted by the work rolls 1 such as to impinge upon the stationary shoes 4 and slip thereon thereby causing local wear on the surfaces of the stationary shoes 4. In addition, fine cracks which are attributable to thermal stresses are formed on the surfaces of the stationary shoes 4. The local wear and cracks on the shoe surfaces tend to cause seizure between the shell 3 and the stationary shoes 4, which in turn causes scratches called "shoe-scratch" on the surfaces of the rolled shell 3, resulting in a deterioration of the quality of the shell 3. Once this seizure takes place, it is necessary to stop the operation of the rolling mill, in order to repair the stationary shoe 4 or to renew the same. This seriously impairs the production efficiency of the rolling line and increases production costs.

FIG. 16 is a front elevational view of a cross helical rolling mill proposed in Japanese Utility Model Laid-Open No. 60509/1981, in order to obviate the above-described problems caused by the use of the stationary shoes 4. This cross helical rolling mill employs roller shoes 10 which are rotatable so as to guide the shell 3 without any slip between the shell 3 and the surfaces of the roller shoes 10. The roller shoes 10, however, are not power-driven, although they are rotatable. Namely, the roller shoes 10 are idle rollers. Therefore, once the shell is forced into the spaces between the roller shoes 10 and the work rolls 1, the roller shoes 10 do not function to expell the shell 3 from such spaces. In consequence, the rolling has to be stopped because of jamming of the shell 3. This phenomenon is referred to as "sticker". In order to eliminate this sticker, a guide plate 11 may be provided in each of the spaces between the work rolls 1 and the roller shoes 10. The guide plates 11, however, suffer the same problems as those encountered by the stationary shoes mentioned before, so that the advantage derived from the use of the roller shoes 10 cannot be fully enjoyed. If the roller shoes 10 have the same length as the stationary shoes, the roller shoes are deflected by thrust forces due to the excessively lengthy span, so that suitable back-up rolls 12 have to be employed in order to back-up the roller shoes 10.

Thus, in the conventional cross helical rolling mill having guide shoes such as stationary shoes, disk guide shoes and roller shoes, it is not possible to conduct rolling smoothly while stably supporting the material under the rolling.

In order to eliminate these problems, the present inventors have already proposed a cross helical rolling mill, in Japanese Patent Application No. 175211/1983 (Japanese Patent Laid-Open No. 68104/1985). This cross helical rolling mill employs power-driven drive roller shoes arranged obliquely on both sides of the rolling region defined by the work rolls. In this cross helical rolling mill, the drive roller shoes impart a torque to the material under rolling, so that the rolled material is forced towards the adjacent work roll, while being guided by the drive roller shoes. It is, therefore, possible to effect a sxooth rolling with a compact arrangement.

This cross helical rolling mill proposed by the inventors, however, suffers a problem in that the shell 3 on the plug 2 is squeezed into the gap between each work roll and adjacent drive roller shoe 10A as shown in FIG. 17. The squeezing of the shell 3 causes an oscillation of the shell 3, causing an uneven thickness distribution in the circumferential direction, i.e., a lack of uniformity of thickness in the circumferential direction.

On the other hand, the work roll 1 pulls back the squeezed portion of the shell 3, and causes the same to move ahead in a spiral state, so that the rolling efficiency is lowered undesirably.

The tendency for the shell 3 to be squeezed in this way is serious particularly at the rear end portion of the shell 3 because of lack of material portion which would produce a force capable of restraining the deformation. In consequence, the shell 3 tends to be jammed into the gap between the work roll 1 and the drive roller shoe 10A, resulting in an inferior separation of the shell from the rolling mill. The thicker the shell 3 is or the greater the thickness reduction is, the more serious the influence of the squeezing of the shell 3.

The squeezing of the shell 3 is more likely to occur at the leading and trailing ends of the shell 3 than at the central portion of the same. Namely, while the squeezing of the central portion of the shell only results in an uneven circumferential thickness distribution or a reduction in the rolling efficiency, the squeezing at the leading and trailing ends tends to become excessive in amount, often causing jamming of the rolled material between the work roll 1 and the drive roller shoe 10A, and this results in a rolling failure.

It might be possible to increase the torque of the drive roller shoe, in order to limit the amount of squeezing which takes place at the leading and trailing ends of the shell 3. In order to maintain the large torque during the rolling, however, it is necessary to employ a driving motor of large capacity for driving the drive roller shoes.

SUMMARY OF THE INVENTION

Accordingly, an object of the invention is to provide a method of and apparatus for suitably controlling the operation of a cross helical rolling mill having drive roller shoes, in such a manner as to ensure a higher quality of the rolled product, as well as improved shoe life.

Another object of the invention is to provide a method of and apparatus for controlling the operation of a cross helical rolling mill, in which squeezing of the shell between the work rolls and drive roller shoes is restrained, so as to assure smooth rolling and a high quality of the rolled product.

Another object of the invention is to provide a method of and apparatus for controlling the operation of a cross helical rolling mill in which squeezing of the shell is effectively restrained over the entire length of the shell, using a drive motor of a comparatively small capacity.

To this end, according to an aspect of the invention, there is provided a method of controlling the operation of a cross helical rolling mill of the type having a pair of work rolls arranged at respective predetermined lead angles, and a pair of power-driven drive roller shoes arranged obliquely at predetermined lead angles on both sides of the rolling region formed between both work rolls, the method comprising: controlling the rotation speed of each of the drive roller shoes in synchronism with the speed of rotation of the rolled material such that the difference in the peripheral speed between each of the drive roller shoe and the rolled material falls within a predetermined range; and, simultaneously with the control of the speed, controlling the driving torque applied to each of the drive roller shoes.

In this arrangement, the drive roller shoe imparts a torque to the rolled material in such a manner that the slip between the drive roller shoe and the rolled material is maintained within a predetermined allowable range, whereby the rolled material is held securely and stably. Namely, according to the invention, it is possible to improve the quality of the rolled product, while obtaining longer life of the shoe.

According to another aspect of the invention, there is provided a method of controlling the operation of a cross helical rolling mill of the type having a pair of work rolls arranged at respective predetermined lead angles, and a pair of power-driven drive roller shoes arranged obliquely at predetermined lead angles on both sides of the rolling region formed between both work rolls, the method comprising: detecting the shoe reactional forces F acting on the drive roller shoes; and controlling and driving the drive roller shoes such that the ratios of the shoe tangential forces P to the shoe reactional forces F are not smaller than 0.07.

FIG. 8 schematically shows this type of cross helical rolling mill under the rolling operation. In this Figure, a reference numeral 32 denotes a shell, 21 denotes work rolls, 31 denotes drive roller shoes and 32 denotes a plug. Shoe reactional forces acting on the drive roller shoes 31 are represented by FR and FL, while tangential forces of the drive shoe rollers 31 are represented by PR and PL. Symbols TR and TL represent, respectively, the driving torques of the drive roller shoes 31. A symbol r represents the radius of the drive roller shoe 31.

Thus, the driving torques TR and TL are given by the following formulae:

$$TR = PR\ r \quad (1)$$

$$TL = PL\ r \quad (2)$$

It will be seen that symbols R and L represent, respectively, right-hand side and left-hand side as viewed in the drawings.

FIG. 9 is a diagram showing the relationship between a shoe torque index $\mu$ and a thickness variance index $\alpha$. The shoe torque index $\mu$ is the ratio of the shoe tangential force P to the shoe reactional force F. Thus, the shoe torque index is given by the following formula, for each of the drive roller shoes:

$$\mu = PR/FR \quad (3)$$

$$\mu = PL/FL \quad (4)$$

On the other hand, the thickness variance index $\lambda$ is the ratio of the shell thickness variance $\alpha$ as obtained when the drive roller shoes are used to the thickness variance $\lambda_O$ of the shell as obtained when stationary shoes are used. Thus, the thickness index is given by the following formula:

$$\alpha = \lambda/\lambda_0 \quad (5)$$

The thickness variance in this case is the mean value of thickness variances of all cross-sections of the shoe. The thickness variance of each cross-section is given as the percentage of a value which is obtained by dividing the difference between the maximum value $t_{max}$ and the minimum value $t_{min}$ of the shell thickness t by the average thickness $t_{av}$. From FIG. 9, it will be seen that, when the shoe torque index $\lambda$ is not smaller than 0.07, a thickness variance index $\alpha$ equivalent to that obtained with the use of stationary shoes is attainable with the use of the drive roller shoes.

FIG. 10 is a diagram showing the relationship between the shoe torque index $\mu$ and a rolling efficiency index $\beta$. The rolling efficiency index $\beta$ is given as the ratio of the forward moving speed v of the shell to the forward component $v_0$ of the peripheral speed of the work roll and, hence, represented as follows:

$$\beta = v/v_0 \quad (6)$$

From this Figure, it will be seen that, when drive roller shoes are used, a rolling efficiency equivalent to that obtained with the use of the stationary shoes is attained on condition that the shoe torque index $\mu$ is not smaller than 0.07.

Therefore, by controlling the driving of the drive roller shoes such that the shoe torque index $\mu$ is not smaller than 0.07, it is possible to attain acceptable thickness variance of the shell, as well as the rolling efficiency, i.e., to prevent any squeeze of the shell from the work roll and the drive roll shoe, while enabling a smooth rolling and high quality of the rolled product.

According to still another aspect of the invention, there is provided a method of controlling the operation of a cross helical rolling mill of the type having a pair of work rolls arranged at respective predetermined lead angles, and a pair of power-driven drive roller shoes arranged obliquely at predetermined lead angles on both sides of the rolling region formed between both work rolls, wherein the torques of said drive roller shoes is maintained at a higher level during the rolling of both longitudinal end portions of said material than during the rolling of longitudinal intermediate portion of said material.

According to this method, although a large torque is applied by the drive roller shoes to the ends of the shell where there is greater tendency for squeezing of the shell to coccur, a reduced torque is applied to the intermediate portion of the shell where the squeezing tendency is comparatively small. It is, therefore, possible to prevent the squeezing of the shell over the entire length thereof, while reducing the overload capacity (RMS) of the driving motor, thus allowing the use of a driving motor having a reduced capacity.

According to a further aspect of the invention, there is provided an apparatus for controlling the operation of a cross helical rolling mill having a pair of work rolls arranged at a predetermined lead angle and each having an inlet interfacial angle and an outlet interfacial angle, and a pair of power-driven drive roller shoes arranged obliquely at a predetermined lead angle at positions adjacent to the work rolls, the drive roller shoes having an inlet interfacial angle and an outlet interfacial angle, the apparatus comprising: a rotation speed detecting means for detecting the rotation speeds of the drive roller shoes; a pair of hot metal detecting means disposed at the outlet side of the cross helical rolling mill and spaced from each other by a predetermined distance so as to detect the actual piercing speed of a shell; an input means for inputting the values which are set by a shell outside diameter setting device, a work roll outside diameter setting device and a drive roller shoe outside diameter setting device; a computing means adapted for receiving the values inputted by the input means and for computing a command rotation speed of the drive roller shoes in accordance with the values; and a speed control means for controlling the rotation speeds of the drive shoe rollers in accordance with the command rotation speed.

DESCRIPTION OF THE PREFERRED EMBODIMENTS

(First Embodiment)

Figure 4:
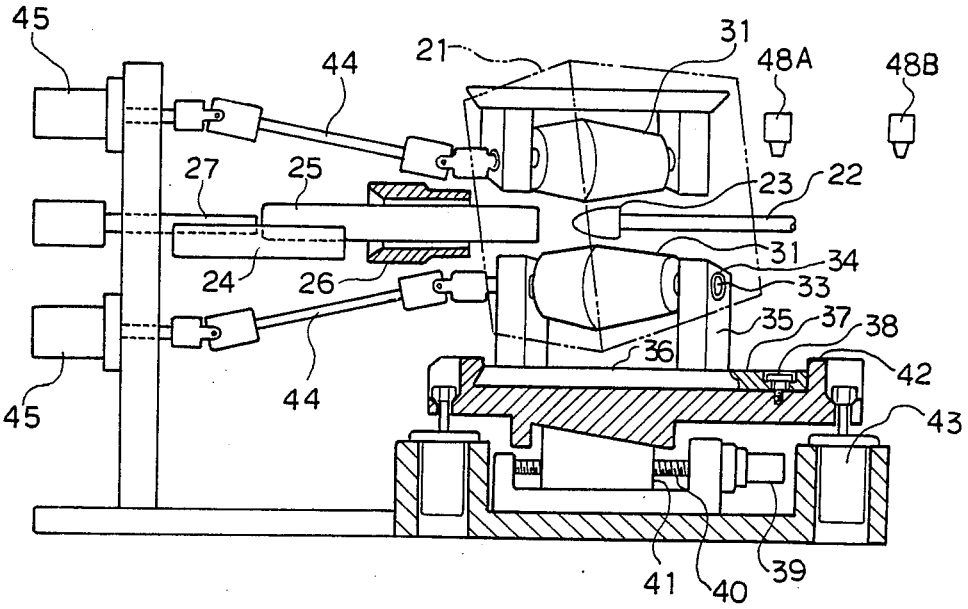
FIG. 4 is a partially-sectioned side elevational view of a cross helical rolling mill to which the present invention is applied.
Figure 5:
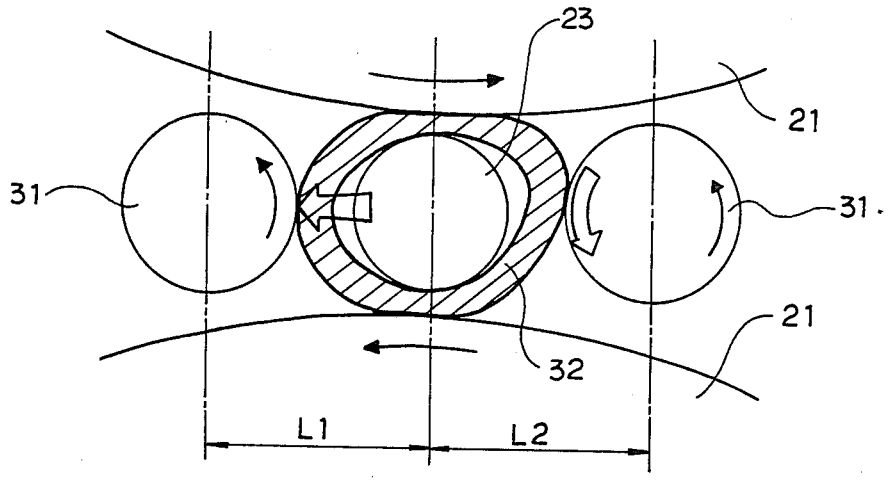
FIG. 5 is a front elevational view illustrating the state of rolling conducted by the cross helical rolling mill shown in FIG. 4.

FIG. 4 is a side elevational view of an example of a cross helical rolling mill to which the invention is applied, while FIG. 5 is a front elevational view of the rolling mill showing the state of rolling operation.

This cross helical rolling mill has a pair of work rolls 21 and a plug 23 which is disposed between these work rolls and supported by a plug bar 22. The work rolls 21 have an inlet interfacial angle and an outlet interfacial angle, and are arranged at a predetermined lead angle of, for example, about 10° to 12°. The work rolls 21, therefore, can tract a round billet 25 on a trough 24 such that the billet 25 moves forwardly while rotating in the circumferential direction. The billet 25 on the trough 23 is pushed by a pusher 27 while being guided by a cannon 26 so as to be fed into the gap between two work rolls 21.

Both work rolls 21 are driven by a D.C. motor 29 through a speed reducer 28. A reference numeral 30 designates a tachogenerator which is capable of detecting the rotation speed Nm of the work rolls 21. The result of detection is transmitted to a computing controller 47 which will be explained later. A pair of drive roller shoes 31 are interposed between both work rolls 21. Each of the drive roller shoes 31 has such an inlet interfacial angle that the outside diameter thereof is progressively reduced from the axially central portion towards the shell inlet side thereof, and such an outlet interfacial angle that the outside diameter thereof is progressively increased from the axially central portion thereof towards the shell outlet side. The drive roller shoe 31 is arranged obliquely at a lead angle of, for example, 3° to 4°, with respect to the axis of the shell 32, so that a velocity component in the direction of movement of the shell 32 is obtained on the peripheral surface of the drive roller shoe 31.

The shaft 33 of the drive roller shoe 31 is supported by a bearing 34 and a support 35. A wedge 37 is secured to the base 36 of the support by means of a bolt 38 so as to be detached easily therefrom. The arrangement is such that, by rotating a screw shaft 40 by means of a hydraulic motor 39, a tapered base 41 is slid so as to lift or lower a lower frame 42 by wedging action, thus enabling fine adjustment of the position of the drive roller shoe 31 which is shown at the lower side in FIG. 4. After the fine adjustment, the drive roller shoe 31 is locked by a hydraulic cylinder 43.

Each of the drive roller shoe 31 is drivingly connected to a D.C. motor 45 through a universal joint 44. A reference numeral 46 denotes a tachogenerator which detects the rotation speed Ns of the drive roller shoe 31. The drive roller shoe 31 may be driven by a speed-controllable hydraulic motor, instead of the D.C. motor 45.

Figure 1:
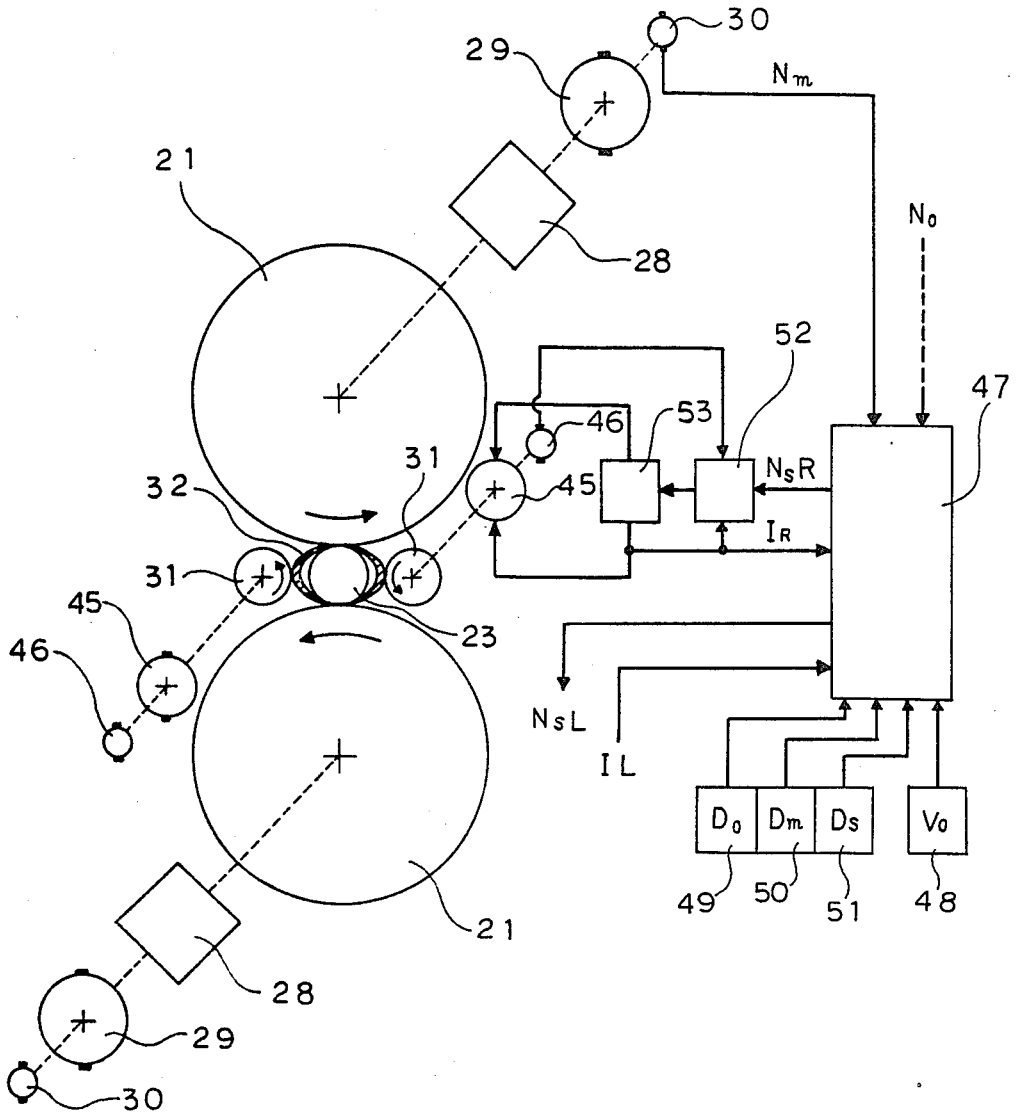
FIG. 1 is a schematic control block diagram in accordance with an embodiment of the invention.

FIG. 1 shows the control circuit for the above-described cross helical rolling mill. This control circuit includes the computing controller 47 mentioned before and a piercing speed detector 48. The piercing speed detector 48 has a pair of hot metal sensors 48A and 48B which are disposed at the outlet side of the rolling mill, leaving a predetermined distance therebetween, and are adapted to detect the actual piercing speed Vo for piercing the shell 32. The control circuit further has a setting device 49 for setting the outside diameter $D_0$ of the shell 32, a setting device 50 for setting the outside diameter Dm of the work roll 21, a setting device 51 for setting the outside diameter Ds of the drive roller shoe 31, a speed controller 52, and a power supply 53 incorporating thyristors.

Figure 2:
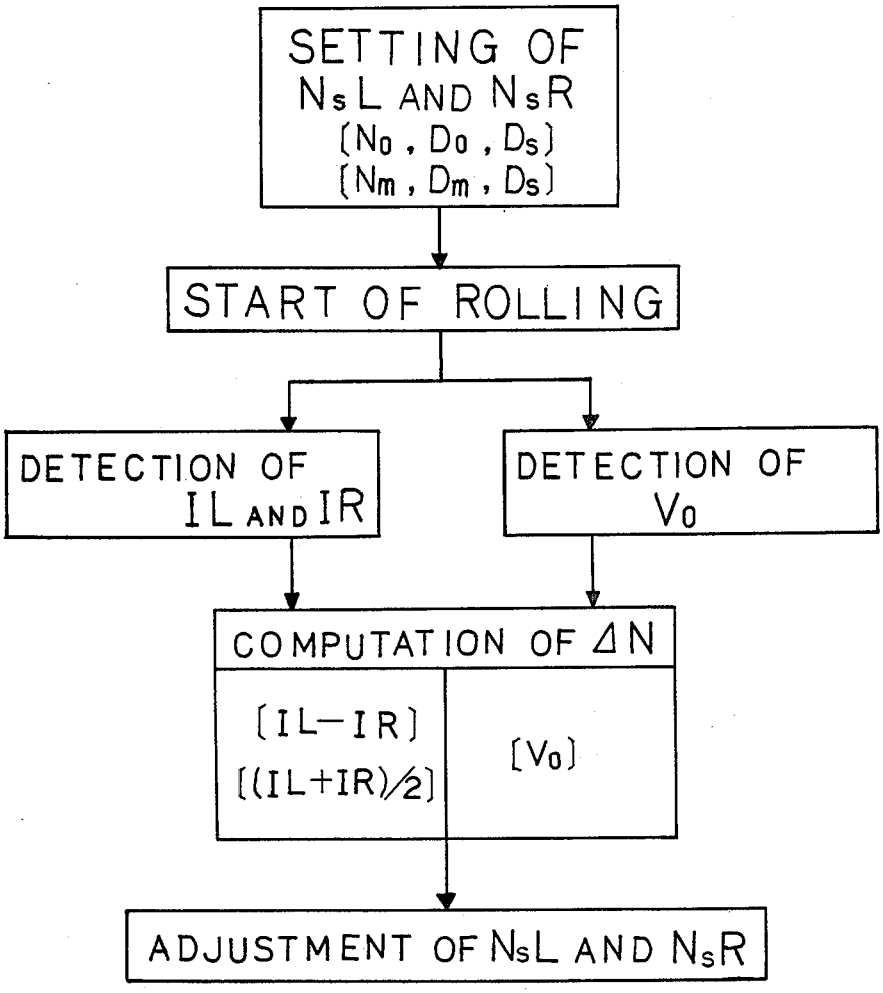
FIG. 2 is a flow chart showing the process of control in the embodiment shown in FIG. 1.

The process of control performed by the above-described computing controller 47 will be described hereinunder with specific reference to FIG. 2.

As the first step, the computing controller 47 sets the rotation speeds Ns (NsL, NsR) which are to be imparted to both drive roller shoes 31, in accordance with the following formula (7) or (8):

$$Ns=(N_0 \cdot D_0)/Ds \quad (7)$$

$$Ns=(Nm \cdot Dm)/Ds \quad (8)$$

Namely, the computing controller 47 computes the rotation speed Ns of the drive roller shoe 31 on the basis of the rotation speed $N_0$ of the shell 32, outside diameter $D_0$ of the shell 32 and the outside diameter Ds of the drive roller shoe 31 or, alternatively, on the basis of the rotation speed Nm which has a certain correlation to the rotation speed $N_0$ of the shell 32, outside diameter Dm of the work roll 21 and the outside diameter Ds of the drive roller shoe 31.

The computing controller 47 then delivers the thus computed rotation speeds NsL and NsR for the left and right drive roller shoes 31 to the speed controllers 25 corresponding to respective speed controllers 52 which in turn control the operation of the D.C. motors 45 for the drive roller shoes 31 through respective thyristor-type power supplies 53.

Then, the billet 25 is fed into the rolling mill, thereby to form the shell 32.

Figure 3:
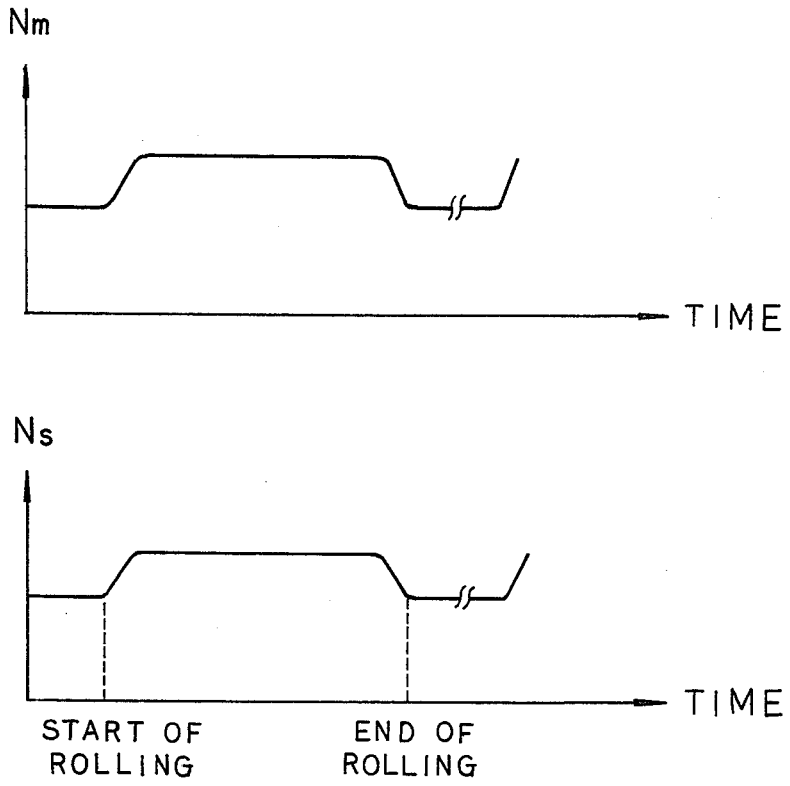
FIG. 3 is a diagram showing the state of control in accordance with the embodiment shown in FIG. 1.

FIG. 3 is a diagram showing the operation of the patterns of changes in the rotation speed Nm of the work roll 21 and the rotation speed Ns of the drive roller shoe 31. The rotation speed Ns of the drive roller shoe 31 is controlled in syncronism with the rotation speed Nm of the work roll 21, over the entire length of the shell 32. In consequence, the drive roller shoes 31 are rotatingly driven at a peripheral speed which coincides with the peripheral speed of the billet 25 and the shell 32, so that the billet 25 and, hence, the shell 32 are stably supported by the drive roller shoes 31 without any slip on the latter.

A speed control referred to as "zooming control" is known in which the rotation speed of the work rolls 21 is reduced by 20% to 30% from the normal speed when the leading end of the billet 25 or the trailing end of the shell 32 comes into or leave the gap between the work rolls 21, in order to attain smooth feed of the billet 25 into the rolling mill, as well as smooth separation of the shell 32 from the rolling mill. In this embodiment, even when this zooming control is conducted on the work rolls, the drive roller shoes 31 are controlled such that their rotation speed is changed following up the change in the speed of the work rolls 21.

The actual rotation speed Ns of the D.C. motor for each drive roller shoe 31 is fed back to the corresponding speed controller 25, thus allowing a feedback control of the operation state of the D.C. motor 45.

In order to control the speeds of the drive roller shoes 31, it is necessary that the loads on respective motors are within a predetermined allowable load range. Namely, if the load on one of the D.C. motors 45 becomes excessively large as compared with the load on the other D.C. motor, the other D.C. motor materially cannot contribute to the speed control. The amounts of work done by the D.C. motors for both drive roller shoes 31 are determined mainly by the rotation speeds NsL and NsR of both drive roller shoes and the distances L1 and L2 of both drive roller shoes from the center of the plug 23 (see FIG. 5). The amounts of work done by the D.C. motors 45 are detected in terms of the levels IL, IR of the electric current supplied to the D.C. motors 45. In this embodiment, the electric current levels IL and IR of both D.C. motors 45 are detected during the rolling of the shell 32, and the detected values are delivered to the computing controller 47. Upon receipt of these values, the computing controller 47 computes the difference IL−IR and, when the difference has exceeded a predetermined value, i.e., when the current in one of the motors has exceeded 110% of the rated current, the computing controller 47 operates to reduce the speed of the drive roller shoe 31 corresponding to this electric motor 45 by ΔN, thereby adjusting the rotation speeds NsL and NsR of both drive roller shoes 31. Alternatively, the distances L1 and L2 mentioned before may be changed instead of the change in the rotation speed, when the above-mentioned difference has exceeded a predetermined value. As a result, the amounts of work done by the D.C. motors 45, i.e., the levels of load on both D.C. motors 45, are balanced so as to stabilize the speed control of the drive roller shoes 31 by the electric motors 45.

The computing controller 47 computes the mean value (IL+IR)/2 of the electric currents of both D.C. motors for each shell 32, and learns the same as the mean value of the electric currents of both D.C. motors 45 for all the shells 32 of the same lot. The thus learned mean current value is stored as the optimum current value of the D.C. motors 45 for each shell 32 of the same lot, i.e., as the command value which is to be given to the D.C. motors for driving the drive roller shoes 31 at reference rotation speeds NsL and NsR.

In the embodiment described hereinbefore, it is not essential that the peripheral speeds of the drive roller shoes 31 precisely coincide with the peripheral speed of the billet 25 or the shell 32. Namely, all what is required is that the rotation speed Ns of the drive roller shoe 31 is controlled in synchronism with the rotation speed Nm of the work roll 21 and, hence, the rotation speed $N_0$ of the shell 32 in such a manner that the offset of the speed control, i.e., the difference between the rotation speed Ns of the drive roller shoe 31 and the rotation speed Nm of the work roll 21 or the rotation speed $N_0$ of the shell 32 falls within a predetermined allowable range. Namely, if the above-mentioned offset falls within the allowable range, the slip between the drive roller shoes 31 and the billet 25 or the shell 32 is so small that no unfavourable effect is produced in terms of either the quality of the product or the efficiency of the rolling operation.

In this embodiment, a speed control is conducted such that, when the actual piercing speed $V_0$ is below a predetermined command piercing speed Va, the power supplied to the drive roller shoes 31 on the shell 32 is increased so as to increase the actual piercing speed $V_0$, without causing the difference in the peripheral speed between the drive roller shoes 31 and the shell 32 to exceed the allowable range. The actual piercing speed for piercing the shell 32 is measured by the piercing speed detector 48 as stated before. The command piercing speed Va of the shell 32 is selected to be, for example, 95% of a theoretical piercing speed Vt which is given by the following formula:

$$Vt=\pi Nm \cdot Dm \cdot Sin\ \alpha/60 \cdot i \quad (9)$$

where, represents the lead angle of the work roll 21, while i indicates the speed reducing ratio of a reduction gear 28. It will be seen that the theoretical piercing speed Vt is the value which affords 100% piercing efficiency. The amounts of work done by the drive roller shoes 31 are adjustable through the control of the rotation speeds Ns of the drive roller shoes 31 driven by the D.C. motors 45, as well as control of the distances L1 and L2 of the drive roller shoes 31 from the center of the plug 23 explained before in connection with FIG. 5. According to the invention, therefore, it is possible to increase the piercing speed $V_0$ beyond the command piercing speed Va through a suitable adjustment of the amounts of work done by the drive roller shoes 31, thereby appreciably improving the production efficiency of the rolling line, without causing any degradation of the quality of the shell and without shortening the life of the drive shoes 31.

As will be understood from the foregoing description, in the first embodiment of the invention, the speeds of the drive roller shoes are controlled in synchronism with the speeds of the work rolls and, hence, the speed of the shell 32, so that the difference in the peripheral speed between the drive roller shoes 31 and the work rolls 21 is substantially nullified or reduced to fall within a predetermined allowable range, so that the rolling of the shell 32 from the billet 25 is smooth and the quality of the rolled product is improved, while attaining a longer life of the drive roller shoes. In addition, the speed of piercing of the shell 32 can be increased by the power of the drive roller shoes 31, thus attaining a higher production efficiency of the rolling line.

An experimental operation of a cross helical rolling mill in accordance with the method of the invention showed 10% reduction in the shoe-scratch in the surface of the shell 32, 5% reduction in the degree of sticker caused by the shell 32, and 10% increase in the life of the drive roller shoe 31. In addition, the production efficiency was increased by 2%, by virtue of the reduced frequency of work for removing the shoe-scratch, and by 3% by virtue of the increase in the piercing efficiency.

As will be fully understood from the foregoing description, according to the first embodiment of the invention, there is provided a method of controlling the operation of a cross helical rolling mill of the type having a pair of work rolls arranged at respective predetermined lead angles, and a pair of power-driven drive roller shoes arranged obliquely at predetermined lead angles on both sides of the rolling region formed between both work rolls, the method comprising: controlling the rotation speed of each of the drive roller shoes in synchronism with the speed of rotation of the rolled material such that the difference in the peripheral speed between each of the drive roller shoe and the rolled material falls within a predetermined range; and, simultaneously with the control of the speed, controlling the driving torque applied to each of the drive roller shoes.

It is, therefore, possible to optimumly control the cross helical rolling mill in such a manner as to attain a higher quality of the rolled product, as well as a longer life for the drive roller shoes.

Figure 6:
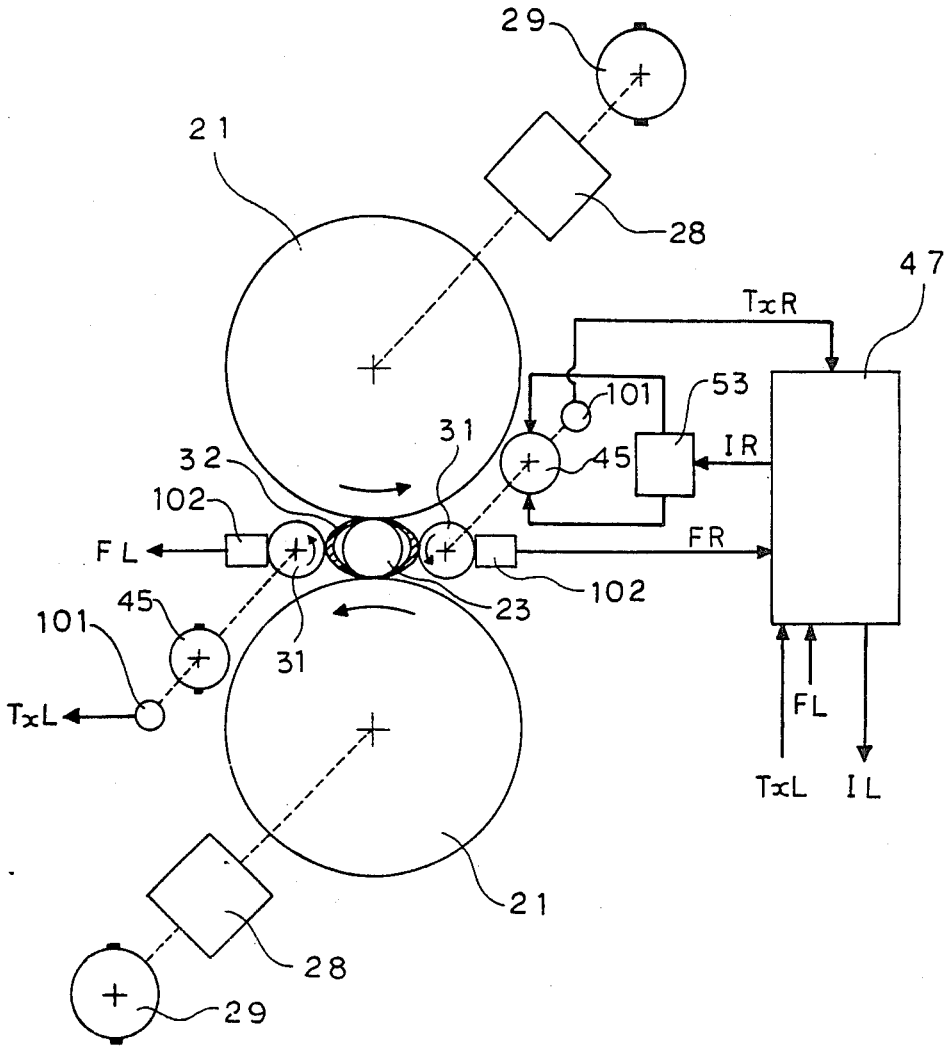
FIG. 6 is a schematic control block diagram in accordance with another aspect of the invention.

Referring to FIG. 6 which is a control circuit diagram of a cross helical rolling mill to which the invention is applied, the drive roller shoes 31 are adapted to be driven by D.C. motors 45. Torque sensors 101 are capable of detecting the actual torques TxR and TxL of both drive roller shoes 31. The drive roller shoes 31 may be driven by speed-controllable hydraulic motors, instead of the D.C.motors. The control circuit includes a computing controller 47 and load cells 102. The load cells 102 are capable of detecting the reactional forces FR and FL acting on the drive roller shoes 31.

Figure 7:
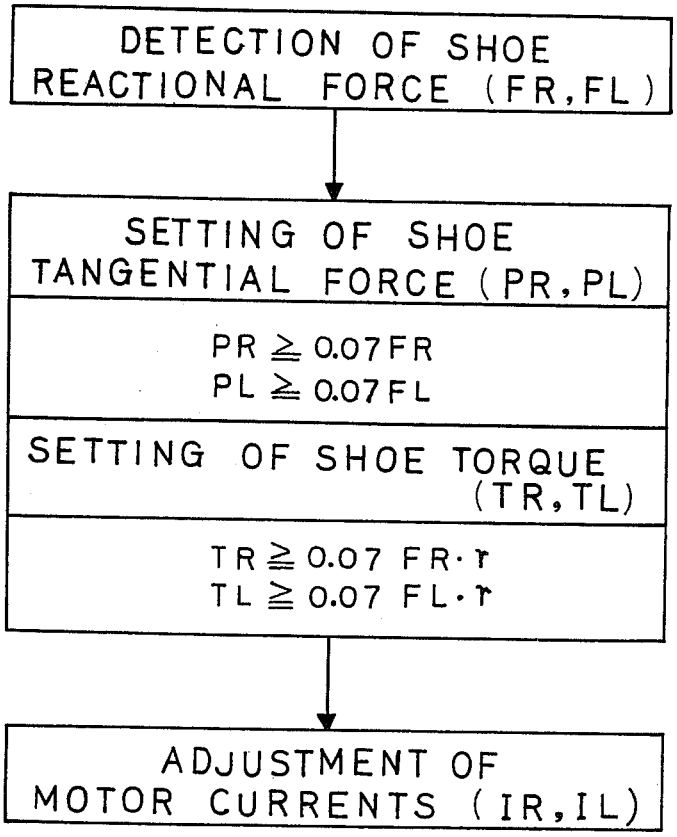
FIG. 7 is a flow chart showing the procedure of control in accordance with the embodiment shown in FIG. 6.
Figure 8:
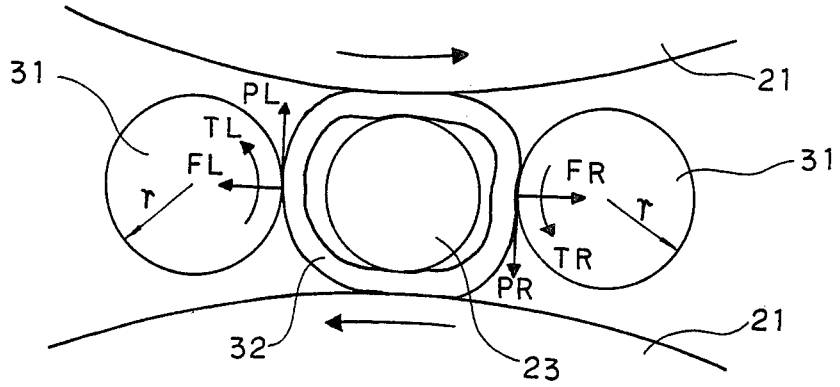
FIG. 8 is a schematic illustration of the state of rolling conducted in accordance with the embodiment shown in FIG. 6.
Figure 9:
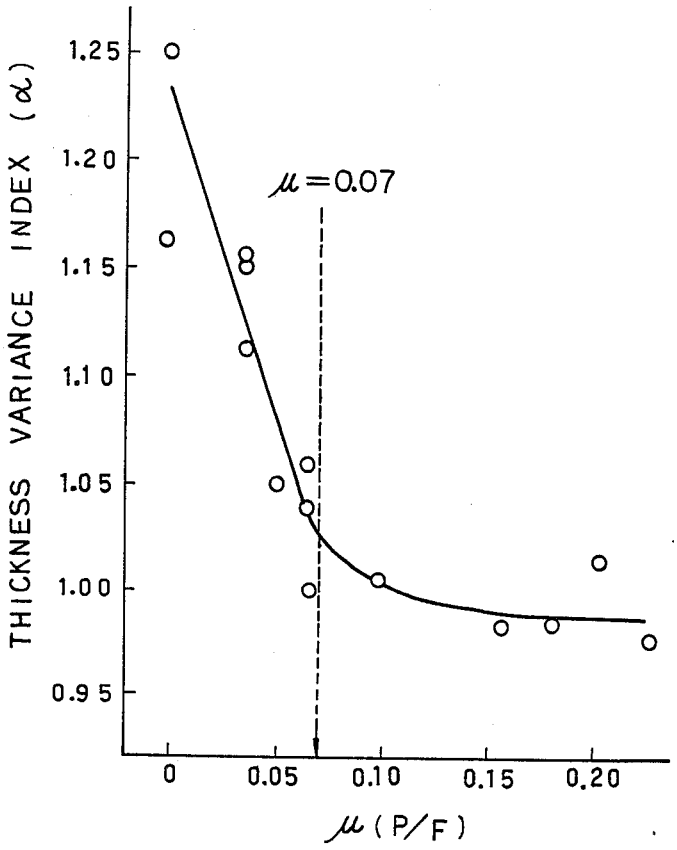
FIG. 9 is a diagram showing the relationship between the shoe torque index and the thickness variance index.
Figure 10:
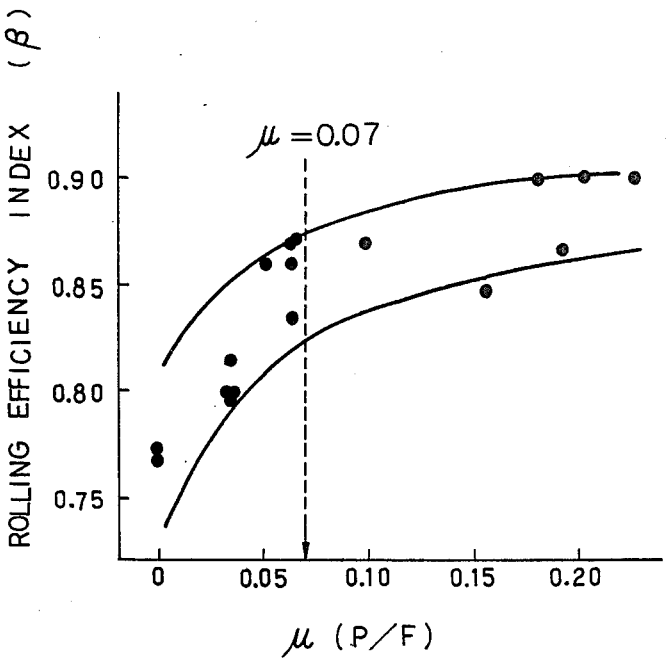
FIG. 10 is a diagram showing the relationship between the shoe torque index and the rolling efficiency index.

The control process performed by the computing controller 47 will be described hereinunder with reference to FIG. 7.

The computing controller 47 computes the shoe tangential forces PR and PL in accordance with the following formulae (10) and (11), on the basis of the shoe reactional forces FR, FL detected by the load cells 102. The computing controller 47 also computes the shoe torques TR and TL in accordance with the formulae (12) and (13). The formulae (10) to (13) have been obtained by substituting the value 0.07 for the coefficient $\mu$ in the foregoing formulae (1) to (4).

$$PR \geqq 0.07\ FR \quad (10)$$

$$PL \geqq 0.07\ FL \quad (11)$$

$$TR \geqq 0.07\ FR.r \quad (12)$$

$$TL \geqq 0.07\ FL.r \quad (13)$$

In accordance with the results of the computation, the computing controller 47 controls the thyristor-controlled power supplies 53 of respective D.C. motors so as to adjust the driving currents IR and IL of respective D.C. motors 45 such that the torques of the drive roller shoes 31 coincide with the above-mentioned values TR and TL. The actual torques TxR and TxL sensed by the torque sensors 101 are fed back to the computing controller 47 so that a feedback control of the operation of the D.C. motors 45 is conducted by the computing controller 47.

In this embodiment, the D.C. motors 45 and, hence, the drive roller shoes 31 are controlled such that the shoe torque index $\mu$ becomes not smaller than 0.07. It is therefore possible to attain excellent values of thickness variance and the rolling efficiency equivalent to those obtained in the cross helical rolling mill having stationary shoes. Namely, the undesirable squeezing of the shell between the work rolls and the drive roller shoes is avoided so as to ensure a smooth rolling of the shell and a high quality of the rolled product.

An experiment conducted by the present inventors proved that the trailing end of the shell can be well rolled to a degree equivalent to that in the rolling under the use of stationary shoes, regardless of the size of the shell, provided that the shoe torque index $\mu$ is selected to be not smaller than 0.07, preferably not smaller than 0.25.

Thus, in this embodiment, there is provided a method of controlling the operation of a cross helical rolling mill of the type having a pair of work rolls arranged at respective predetermined lead angles, and a pair of power-driven drive roller shoes arranged obliquely at predetermined lead angles on both sides of the rolling region formed between both work rolls, the method comprising: detecting the shoe reactional forces F acting on the drive roller shoes; and controlling and driving the drive roller shoes such that the ratios of the shoe tangential forces P to the shoe reactional forces F are not smaller than 0.07.

It is, therefore, possible to restrain the tendency of squeeze of the shell between the work rolls and the drive roller shoes, thereby enabling a smooth rolling of the shell and high quality of the rolled product.

(Third Embodiment)

Figure 11:
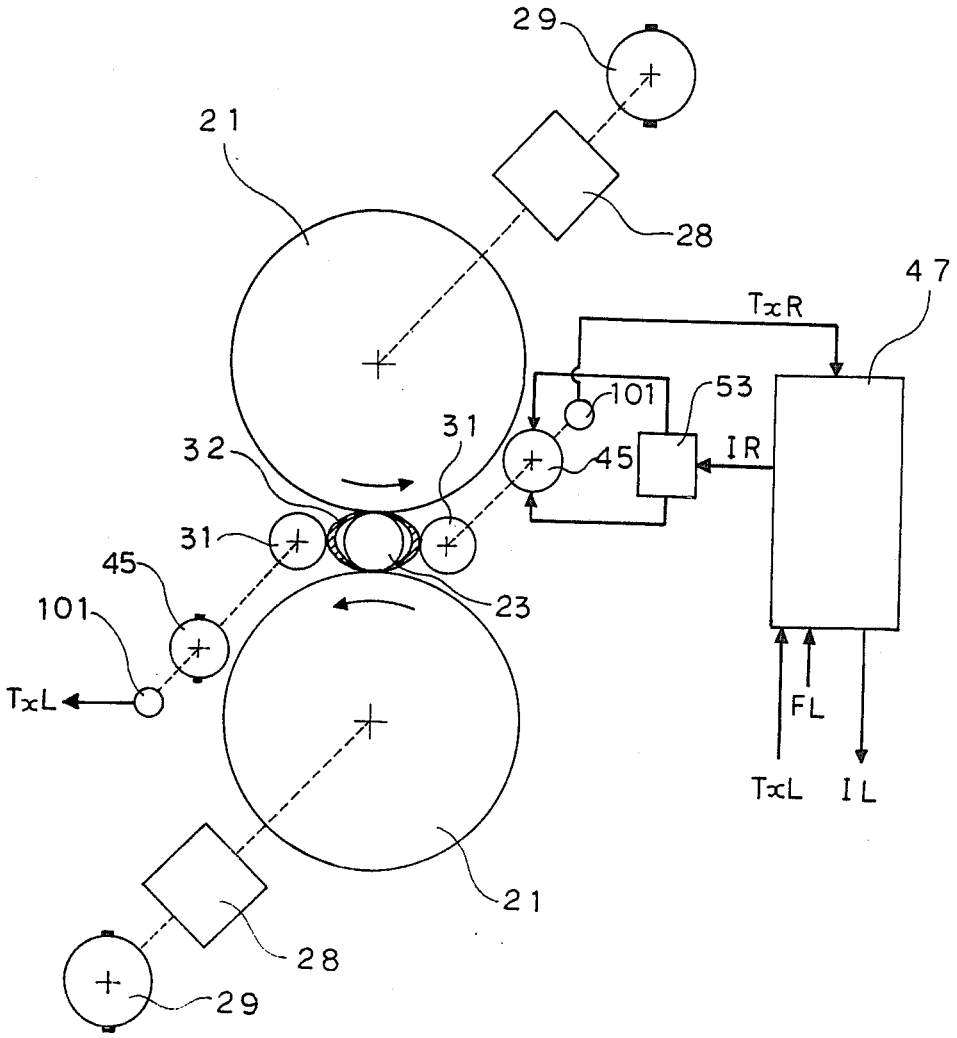
FIG. 11 is a schematic controlling block diagram in accordance with still another embodiment of the invention.

Referring to FIG. 11 which is a control circuit diagram of a cross helical rolling mill to which the invention is applied, the drive roller shoes 31 are adapted to be driven by D.C. motors 45. Torque sensors 101 are capable of detecting the actual torques TxR and TxL of both drive roller shoes 31. The drive roller shoes 31 may be driven by speed-controllable hydraulic motors, instead of the D.C.motors. The control circuit includes a computing controller 47 and thyristor-controlled power supplies 53 for respective D.C. motors 45.

Figure 12:
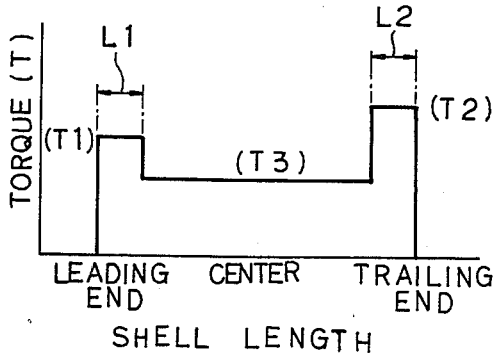
FIG. 12 is a diagram showing the manner in which the torque of the drive roller shoe is controlled.

A material detector (not shown) is adapted to detect what portion of the shell 32 along the length thereof being rolled, and delivers the result of the detection to the computing controller 47. Upon receipt of this result, the computing controller 47 operates to set the levels of the torques T1 and T2 for the rolling of the leading end portion (length L1) of the shell 32 and the trailing end portion (length L2) of the same to be greater than the level of the torque T3 for rolling the longitudinal intermediate portion of the shell 32, as shown in FIG. 12. The computing controller 47 then operates the thyristor-controlled power supplies 53 so as to control the driving electric currents IR and IL of the D.C. motors 45, such that the set values of the torques T1, T2 and T3 are obtained. In addition, the computing controller 47 performs a feedback control of the state of driving of the electric motors 47, upon receipt of signals from torque sensors 101 which sense the actual torques TxR and TxL of the drive roller shoes 31.

It is to be pointed out here that the trailing end portion of the shell 32 following the region which has been already rolled, expanded and thinned by the rolling mill, receives a smaller restraining force produced by the shell material against the deformation, as compared with the leading end portion of the shell 32. In consequence, the trailing end portion of the shell 32 tends to exhibit a greater tendency of squeeze than the leading end portion of the same. In view of this fact, in the embodiment described, the torque T2 of the drive roller shoes during rolling of the trailing end portion of the shell 32 is selected to be greater than the torque T1 of the drive roller shoes during the rolling of the leading end portion of the shell 32.

Figure 13:
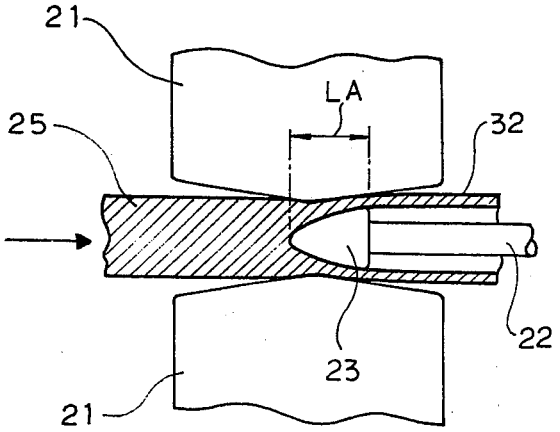
FIG. 13 is a sectional view illustrating a rolling region in a cross helical rolling mill.

The length of each end portion of the shell 32 at which an increased torque T1 or T2 has to be maintained has to be not smaller than the length LA of the region of rolling effected by the work rolls 21 and the plug 23 on the shell 32 as measured in the direction of the rolling pass, as shown in FIG. 13. The length of the end portion of the shell over which the increased torque should be maintained can be increased as desired, within the range which does not cause the overload capacity RMS of the electric motor to exceed the rated value (generally 100%) of the motor.

In this embodiment, although the torques of the drive roller shoes are increased for rolling the leading and trailing end portions of the shell 32 which exhibit greater tendency of the sqeeze of the shell 32, the rolling is conducted with reduced torques during the rolling of the longitudinal intermediate portion of the shell which exhibits a smaller tendency of squeeze as compared with both end portions. It is, therefore, possible to reduce the overload capacity of the electric motors 45 and, hence, to use motors 45 having smaller capacities, while substantially eliminating the risk of squeeze of the shell 32 over the entire length thereof.

The overload capacity RMS of the motor 45 is expressed by the following formula (14):

$$RMS = \sqrt{\frac{1}{T}\int_0^T i^2 dT} \tag{14}$$

Figure 14:
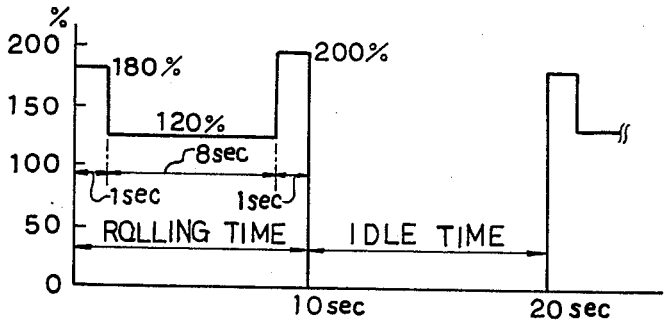
FIG. 14 is a diagram showing a practical example of the result of control effected in accordance with the invention.
Figure 15:
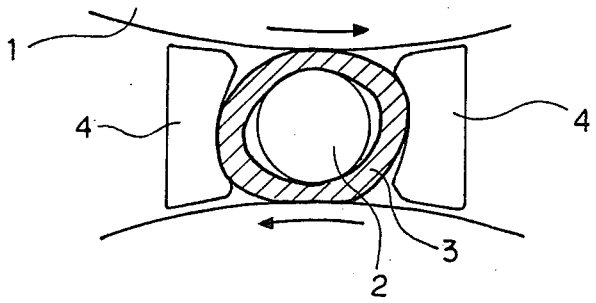
FIG. 15 is a front elevational view of a known cross helical rolling mill incorporating stationary shoes in the state of rolling operation.
Figure 16:
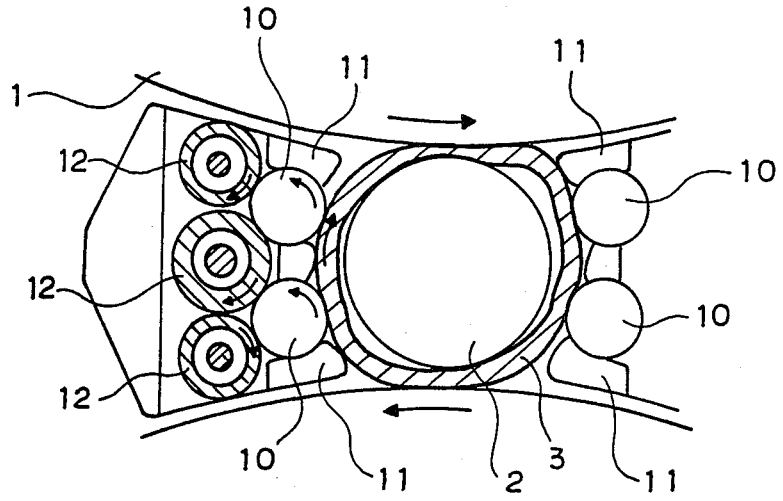
FIG. 16 is a front elevational view of a known cross helical rolling mill incorporating roller shoes in the state of rolling operation.
Figure 17:
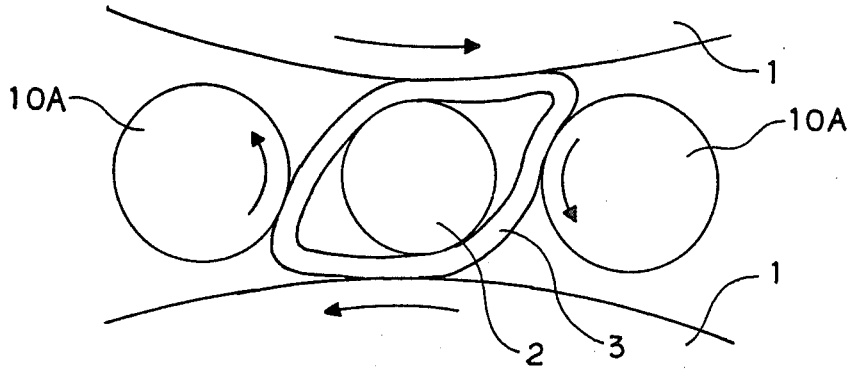
FIG. 17 is a schematic illustration of a known cross helical rolling mill incorporating drive roller shoes, explaining the undesirable squeezing of the shell.

FIG. 14 is a diagram which shows the result of a test operation in accordance with the invention. In this Figure, the axis of abscissa represents the time, while the axis of ordinate represents the motor output. The test was conducted in the form of an elongater rolling. The outside diameter, thickness and the length of the shell at the inlet side of the rolling mill were 185 mm, 19 mm and 5992 mm, respectively, while the outside diameter, thickness and the length at the outlet side of the rolling mill were 199 mm, 10 mm and 10000 mm, respectively. The rolling was conducted in a rolling time of 10 seconds, with an interval idle time of 10 seconds. The outputs of the motors for driving the drive roller shoes were changed to be 180% of the motor rated capacity for the rolling of the leading end portion, 200% of the motor rated capacity for the rolling of the trailing end portion and 120% of the rated motor capacity for the rolling of the longitudinal intermediate portion of the shell 32.

Using the formula (15), the overload capacity of the motor was calculated as shown by a formula (15) below:

$$RMS = \sqrt{\frac{180^2 \times 1 + 120^2 \times 8 + 200^2 \times 1}{20}} = 96.9\% \quad (<100\%) \tag{15}$$

Through this test, it has been confirmed that this embodiment can effectively avoid substantial squeeze of the shell during rolling over the entire length thereof including both longitudinal end portions and intermediate portion, while satisfying the demand from the motor capacity.

It will be seen that the described embodiment provides method of controlling the operation of a cross helical rolling mill of the type having a pair of work rolls arranged at respective predetermined lead angles, and a pair of power-driven drive roller shoes arranged obliquely at predetermined lead angles on both sides of the rolling region formed between both work rolls, the method characterized in that the torques of the drive roller shoes are maintained higher during the rolling of both longitudinal end portions of the material than during the rolling of longitudinal intermediate portion of the mmaterial.

This embodiment offers an advantage in that the rolling can be conducted smoothly without suffering from any squeeze of the shell substantially over the entire length of the shell, while allowing the use of driving motors of a reduced capacity.

Although the invention has been described through specific terms, it is to be understood that the described embodiments are only illustrative and various changes and modifications may be imparted thereto without departing from the scope of the invention which is limited solely by the appended claims.

What is claimed is:

1. A method of controlling the operation of a cross helical rolling mill of the type having a pair of work rolls arranged at respective predetermined lead angles, and a pair of power-driven drive roller shoes arranged obliquely at predetermined lead angles on both sides of the rolling region formed between both work rolls, said method comprising: controlling the rotation speed of each of said drive roller shoes in synchronism with the speed of rotation of the rolled material such that the difference in peripheral speed between each of said drive roller shoe and said rolled material falls within a predetermined range; simultaneously with the control of the speed, controlling the driving torque applied to each of said drive roller shoes; and maintaining the torques of said drive roller shoes higher during the rolling of both longitudinal end portions of said material than during the rolling of longitudinal intermediate portions of said material.

2. A method according to claim 1, wherein the length of each longitudinal end of said material which is to be rolled with the higher level of said torques of said drive roller shoes is not smaller than the length of the region of rolling effected by said work rolls on said material in the direction of the rolling pass.

* * * * *